US010709241B2

(12) United States Patent
Peregrina Loera et al.

(10) Patent No.: US 10,709,241 B2
(45) Date of Patent: Jul. 14, 2020

(54) DRAWER ASSEMBLY WITH INTEGRAL LATCH MECHANISM

(71) Applicant: FORD GLOBAL TECHNOLOGIES, LLC, Dearborn, MI (US)

(72) Inventors: Jose Alfredo Peregrina Loera, Mexico City (MX); Francisco Ronquillo, Puebla (MX); Omar Antonio Ramirez, Portales Norte (MX); Francisco Javier Ferreira, Estado de Mexico (MX)

(73) Assignee: Ford Global Technologies, LLC, Dearborn, MI (US)

( * ) Notice: Subject to any disclaimer, the term of this patent is extended or adjusted under 35 U.S.C. 154(b) by 722 days.

(21) Appl. No.: 14/933,187

(22) Filed: Nov. 5, 2015

(65) Prior Publication Data

US 2017/0127831 A1 May 11, 2017

(51) Int. Cl.
*A47B 88/906* (2017.01)

(52) U.S. Cl.
CPC ..... *A47B 88/906* (2017.01)

(58) Field of Classification Search
CPC ..... A47B 88/16; A47B 88/12; A47B 88/0455; A47B 88/0085
USPC ... 312/330.1, 331, 334.1, 334.7, 319.1, 246; 296/37.1, 37.12
See application file for complete search history.

(56) References Cited

U.S. PATENT DOCUMENTS 2,809,877 A * 10/1957 Hammesfahr ..... A24F 19/08 131/241
2,944,865 A 7/1960 Hammesfahr
3,351,404 A * 11/1967 Blake ..... B60N 3/083 312/246
3,460,876 A * 8/1969 De Boer ..... B60N 3/083 224/280
3,600,051 A * 8/1971 De Boer ..... A47B 88/0407 224/280
3,737,207 A * 6/1973 Clemett, Jr. ..... B60N 3/083 312/246
4,157,853 A * 6/1979 Carey ..... A24F 19/06 131/242
4,423,914 A 1/1984 Vander Ley
4,473,262 A 9/1984 Staye
4,557,531 A 12/1985 Roeck et al.
4,765,699 A 8/1988 Bessinger et al.
4,799,720 A 1/1989 Watson et al.
4,865,368 A 9/1989 McCall et al.
(Continued)

FOREIGN PATENT DOCUMENTS

CN 201105694 Y 8/2008
CN 201480593 U 5/2010

OTHER PUBLICATIONS

"950RV Drawer Retaining Slide System"; Houck Industries, Inc.; http://www.houckind.com/sitepages/950RV/950RVDescription.html; Sep. 3, 2015, pp. 1-2.
(Continued)

*Primary Examiner* — James O Hansen
(74) *Attorney, Agent, or Firm* — David Coppiellie; King & Schickli, PLLC

(57) ABSTRACT

A drawer assembly is provided. That drawer assembly includes a drawer incorporating an integral latch and a bezel incorporating an integral spring. Thus, the drawer assembly includes an integral latch mechanism to hold the drawer in a closed position.

12 Claims, 3 Drawing Sheets

(56) References Cited

U.S. PATENT DOCUMENTS

Figure 1A:
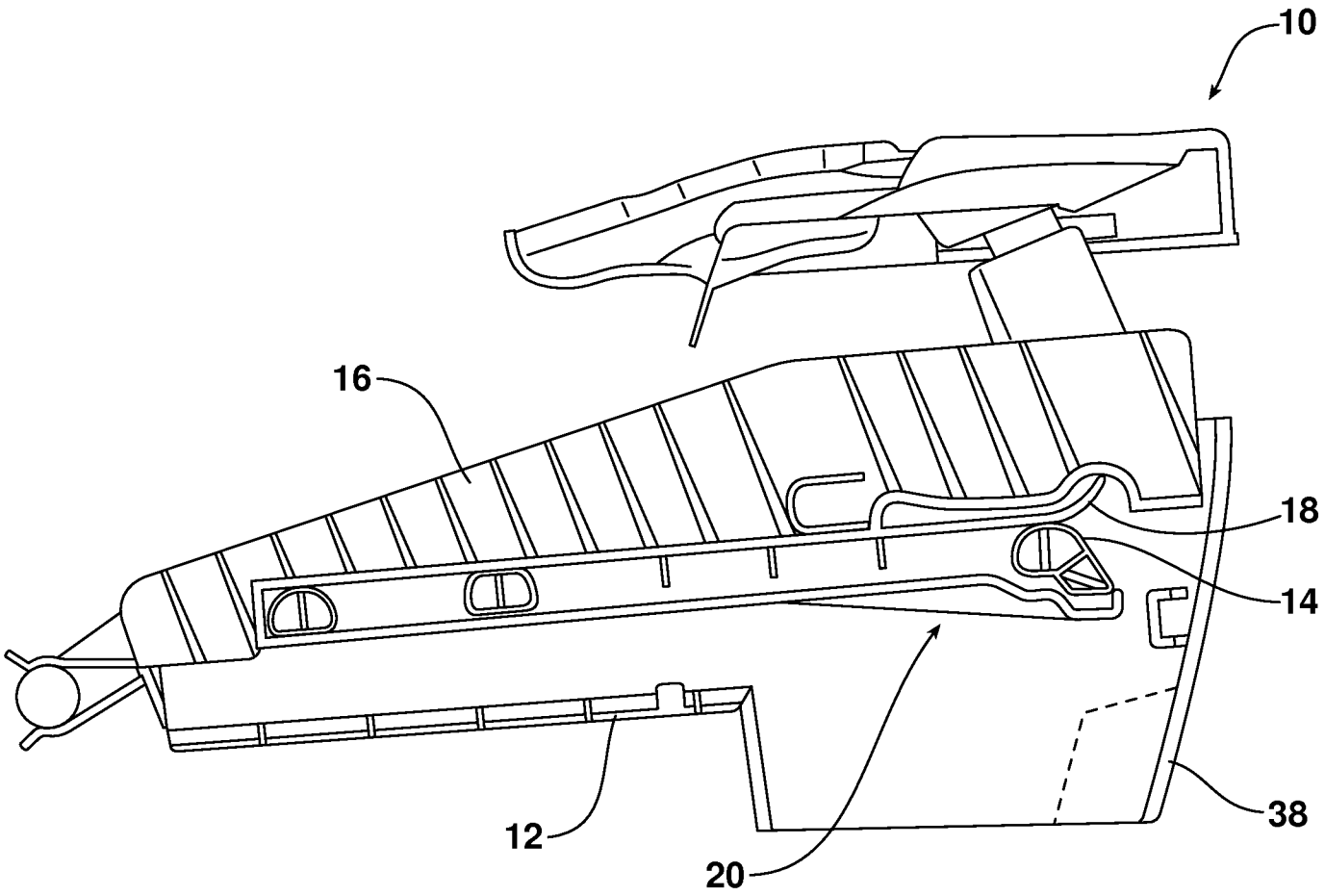

| | | | | |
|---|---|---|---|---|
| 4,953,991 | A | 9/1990 | Roeck | |
| 5,645,340 | A * | 7/1997 | Colton | B60Q 3/007 296/37.9 |
| 5,980,007 | A | 11/1999 | Singh | |
| 6,467,860 | B2 | 10/2002 | Remmers | |
| 6,764,149 | B2 | 7/2004 | Jurja | |
| 7,552,982 | B2 | 6/2009 | Beaudoin | |
| 8,393,663 | B2 * | 3/2013 | Gayon | B60R 7/06 296/37.12 |
| 2001/0033787 | A1 | 10/2001 | Eekhoff | |
| 2010/0052490 | A1 * | 3/2010 | Harrison | B60P 3/14 312/351 |
| 2015/0053684 | A1 | 2/2015 | Nussbaum et al. | |

OTHER PUBLICATIONS

English machine translation of CN201480593U.
English Machine Translation of CN201105694Y dated Aug. 27, 2008.
Office Action dated Jan. 16, 2020 for Application No. CN2016109300119 Filed Oct. 31, 2016.
Search Report dated Sep. 16, 2019 for TR Application filed Oct. 19, 2016.

* cited by examiner

DRAWER ASSEMBLY WITH INTEGRAL LATCH MECHANISM

TECHNICAL FIELD

This document relates generally to the motor vehicle equipment field and, more particularly, to a drawer assembly incorporating an integral latch mechanism.

BACKGROUND

Drawer assemblies incorporating a bezel that receives and hold a sliding drawer are well known in the art. Such assemblies also incorporate a separate latch mechanism connected to the drawer and bezel. Such separate latch mechanisms typically have many component parts driving up the costs of the manufacturing, assembling and servicing processes.

This document relates to a new and improved drawer assembly wherein the latch mechanism is an integral part of the drawer and bezel. Advantageously, this effectively reduces component parts, reduces the cost of manufacturing and reduces the cost of assembly. Fewer parts also mean more reliable and dependable performance over a long service life as well as fewer warranty repairs. Thus, the present drawer assembly represents a significant advance in the art.

SUMMARY

In accordance with the purposes and benefits described herein, a drawer assembly is provided. That drawer assembly comprises a drawer including a latch and a bezel including an integral spring. The drawer is received in the bezel and held in a closed position by engagement of the spring with the latch.

In one particularly useful embodiment, the bezel and the integral spring are formed form a single piece of material. In one possible embodiment, the bezel and the integral spring are molded from a single piece of plastic material. In another possible embodiment, the bezel and the integral spring are molded from a single piece of composite material.

In one particularly useful embodiment, the latch is integral to the drawer. Thus, the latch and drawer are formed from a single piece of material. In one possible embodiment, the latch and the drawer are molded from a single piece of plastic. In another possible embodiment, the latch and the drawer are molded from a single piece of composite material.

More specifically, describing the latch mechanism, the latch includes an arcuate cam surface in engagement with the integral spring when the drawer is in a closed position.

The spring is an elongated lug having a proximal end and a free distal end. The spring is angled downward from the proximal end toward the free distal end and extends in a direction of drawer opening movement so that the spring projects into a path of movement of the latch when the drawer is opened and closed.

Still further, the spring curves upwardly at an intermediate point between the proximal end and the distal end. Thus, the arcuate cam surface of the latch engages the integral spring between the proximal end and the intermediate point when the drawer is in the closed position. As a result, a portion of the integral spring extending downward from the proximal end exerts a downward force on the latch of the drawer holding the drawer in the closed position.

As it should be appreciated, the drawer also includes a handle whereby one may lift the drawer toward the bezel, bending the internal spring to release the drawer for sliding movement in the bezel toward an open position.

In accordance with yet another aspect, a low cost method is provided of manufacturing a drawer assembly. The low cost method may be broadly described as comprising the steps of: (a) molding a drawer with an integral latch so as to be of unitary construction, (b) molding a bezel with an integral spring so as to be of unitary construction and (c) assembling the drawer assembly by sliding the drawer into the bezel. That method may further include the step of latching the drawer in a closed position within the bezel by engagement of the integral spring with the integral latch.

In the following description there are shown and described several different embodiments of a drawer assembly. As it should be realized, the drawer assembly is capable of other, different embodiments and its several details are capable of modification in various, obvious aspects all without departing from the drawer assembly as set forth and described in the following claims. Accordingly, the drawings and descriptions should be regarding as illustrative in nature and not as restrictive.

BRIEF DESCRIPTION OF THE DRAWING FIGURES

The accompanying drawing figures incorporated herein and forming a part of the specification, illustrate several aspects of the drawer assembly and together with the description serve to explain certain principles thereof.

Figure 1B:
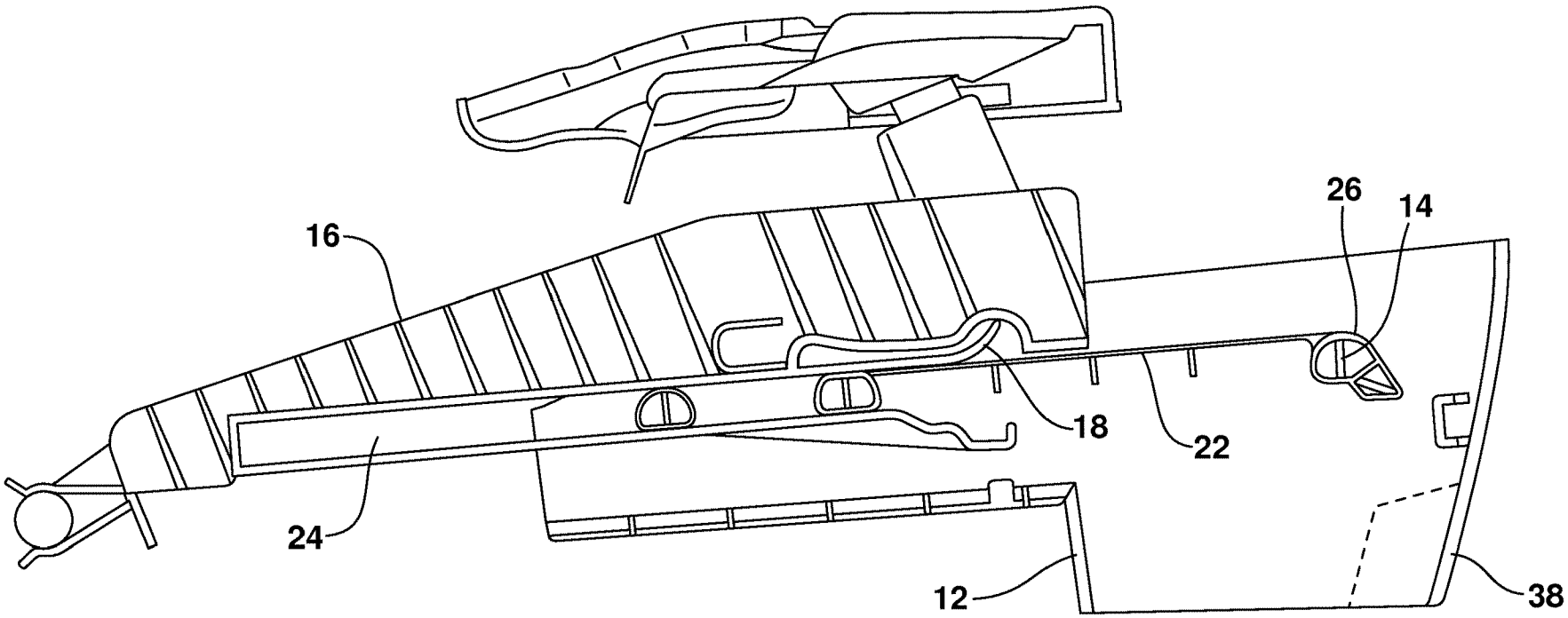

FIGS. 1*a* and 1*b* are side elevational views of the drawer assembly. FIG. 1*a* illustrates the drawer in a closed position while FIG. 1*b* illustrates the drawer in an opened position.

Figure 2:
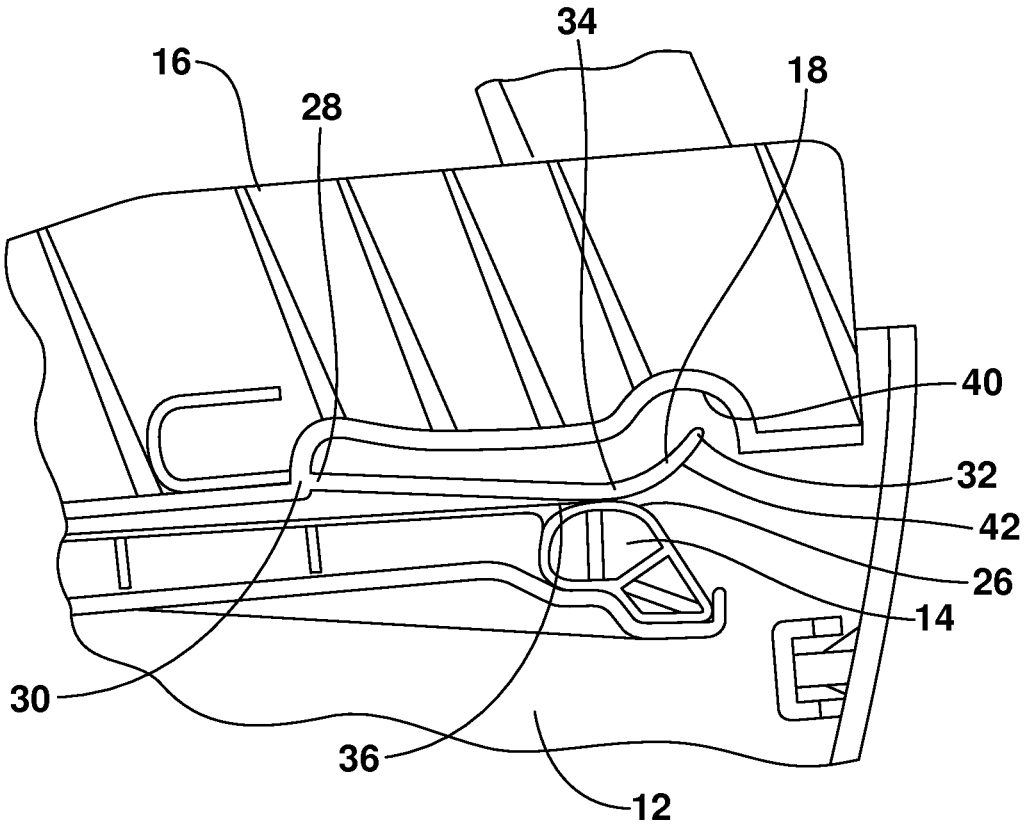

FIG. 2 is a detailed side elevational view illustrating the latch mechanism including the bezel and integral spring and the drawer and integral latch.

Reference will now be made in detail to the present preferred embodiments of the drawer assembly, examples of which are illustrated in the accompanying drawing figures.

DETAILED DESCRIPTION

Reference is now made to FIGS. 1*a*-2 illustrating the drawer assembly 10. As illustrated, the drawer assembly 10 includes a drawer 12 including the integral latch 14 and a bezel 16 including the integral spring 18. As best illustrated in FIG. 2, the latch 14 and spring 18 form the latch mechanism 20 for the drawer assembly 10.

As should be appreciated, the bezel 16 and spring 18 are formed from a single piece of material so as to be of unitary construction. In one possible embodiment, the bezel 16 and the integral spring 18 are molded from a single piece of plastic material. In another possible embodiment, the bezel 16 and the integral spring 18 are molded from a single piece of composite material.

Similarly, the drawer 12 and latch 14 are formed from a single piece of material and thus are of a unitary construction. In one possible embodiment, the drawer 12 and the integral latch 14 are molded from a single piece of plastic material. In another possible embodiment, the drawer 12 and the integral latch 14 are molded from a single piece of composite material.

As should be appreciated since the drawer 12 includes an integral latch 14 and the bezel 16 includes an integral spring 18, the latch mechanism 20 is formed as a part of the drawer 12 and bezel 16. Thus, the latch mechanism 20 is not a separate mechanism or assembly. Accordingly, both production and assembly costs are significantly reduced.

As best illustrated in FIGS. 1*b* and 2, the drawer 12 includes an integral slide rail 22 at each side thereof. The bezel 16 includes an integral guide channel 24 at each side thereof. The slide rail 22 and guide rail 24 on one side of the drawer assembly 12 is illustrated in FIGS. 1*a*, 1*b* and 2. A similar slide rail 22 and guide rail 24 are provided on the opposite side of the drawer assembly 10 and are a mirror image of that illustrated.

As shown, the guide channel 24 receives the cooperating slide rail 22 to hold the drawer 12 for sliding engagement in the bezel 16 so that the drawer may be displaced between the closed position illustrated in FIG. 1*a* and the open position illustrated in FIG. 1*b*.

Reference is now made once again to FIG. 2 which illustrates the latch mechanism 20 in detail. As should be appreciated, one latch mechanism 20 is provided at each side of the drawer assembly 10. More specifically, each latch mechanism 20 includes a latch 14 positioned along the slide rail 22 and a spring 18 positioned along the cooperating guide channel 24. The latch 14 includes an arcuate cam surface 26 that is provided in engagement with the associated spring 18 when the drawer 12 is in a closed position as illustrated in FIG. 2.

The spring 18 is an elongated lug having a proximal end 28 integrally attached to the bezel body 30 and a free distal end 32. As illustrated, the spring 18 is angled downwardly from the proximal end 28 toward the free distal end 32 and in a direction of drawer opening movement so that the spring extends into a path of movement of the latch 14 when the drawer 12 is opened and closed.

As further illustrated, the spring 18 curves upwardly at an intermediate point 34 between the proximal end 28 and the free distal end 32. When the drawer 12 is fully seated in the closed position, the arcuate cam surface 26 of the latch 14 engages the integral spring 18 between the proximal end 28 and the intermediate point 34. As a result, the portion 36 of the spring 18 that extends downward from the proximal end 28 exerts a downward force on the latch 14 of the drawer 12 holding the drawer in a closed position.

The drawer 12 also includes an inset handle 38. One may engage the handle 38 to lift the drawer 12 toward the bezel 16, bending the integral spring 18 and thereby allowing the arcuate cam surface 26 to slide past the intermediate point 34 of the spring releasing the drawer for sliding movement in the bezel toward the open position illustrated in FIG. 1*b*. Here it should be appreciated that the tip or distal end 32 of the spring 18 engages the bezel at the point 40 so as to limit the movement of the drawer in the Z-direction during the opening operation.

When one closes the drawer 12, the arcuate cam surface 26 of the latch 14 engages the arcuate surface 42 of the spring 18 between the intermediate point 34 and the free distal end 32 forcing the spring upward until the arcuate cam surface 26 passes the intermediate point 34 at which time the resilient spring 18 springs back to its home position providing a positive force for retaining the drawer in the closed position (once again see FIG. 2).

In summary, the drawer assembly 10 described herein provides a number of benefits and advantages. By incorporating a latch mechanism 20 that is integral with the drawer 12 and bezel 16, no separate latch assembly is required and manufacturing and assembly costs are greatly reduced. Thus, the drawer assembly 10 is associated with a low cost method of manufacturing comprising: (a) molding a drawer 12 and an integral latch 14 so as to be of unitary construction, (b) molding a bezel 16 with an integral spring 18 so as to be of unitary construction and (c) assembling the drawer assembly by sliding the drawer into the bezel. Further, the method includes latching the drawer 12 in the closed position within the bezel 16 by engagement of the integral spring 18 with the integral latch 14.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. A drawer assembly, comprising:

a drawer including a latch; and a bezel including an integral spring, said drawer being recessed in said bezel and held in a closed position by engagement of said integral spring with said latch, wherein said latch includes an arcuate cam surface in engagement with said integral spring when said drawer is in the closed position, wherein said integral spring is an elongated lug having a proximal end and a free distal end, wherein said integral spring is angled downwardly from said proximal end toward said free distal end and in a direction of drawer opening movement so that said integral spring extends into a path of movement of said latch when said drawer is opened and closed, and wherein said integral spring curves upwardly at an intermediate point between said proximal end and said free distal end.

2. The drawer assembly of claim 1, wherein said arcuate cam surface engages said integral spring between said proximal end and said intermediate point when said drawer is in said closed position whereby a portion of said integral spring extending downward from said proximal end exerts a downward force on said latch of said drawer holding said drawer in said closed position.

3. The drawer assembly of claim 2, wherein said drawer includes a handle whereby one may lift said drawer toward said bezel, bending said integral spring to release said drawer for sliding movement in said bezel toward an open position.

4. The drawer assembly of claim 2, wherein said drawer includes a slide rail and said bezel includes a guide channel receiving said slide rail.

5. The drawer assembly of claim 4, wherein said latch is positioned along said rail and said integral spring is positioned along said guide channel.

6. The drawer assembly of claim 1, wherein said bezel and said integral spring are formed from a single piece of material.

7. The drawer assembly of claim 6, wherein said bezel and said integral spring are molded from a single piece of plastic material.

8. The drawer assembly of claim 6, wherein said bezel and said integral spring are molded from a single piece of composite material.

9. The drawer assembly of claim 6, wherein said latch is integral to said drawer.

10. The drawer assembly of claim 6, wherein said latch and said drawer are formed from a single piece of material.

11. The drawer assembly of claim 6, wherein said latch and said drawer are molded from a single piece of plastic material.

12. The drawer assembly of claim 6, wherein said latch and said drawer are molded from a single piece of composite material.

* * * * *